US006431176B1

(12) United States Patent
Rice

(10) Patent No.: US 6,431,176 B1
(45) Date of Patent: Aug. 13, 2002

(54) TOBACCO SMOKE CONTAINMENT APPARATUS AND METHOD THEREFOR

(76) Inventor: Hiram Allen Rice, 1840 Myrtle Island Dr., Las Vegas, NV (US) 89117

( * ) Notice: Subject to any disclaimer, the term of this patent is extended or adjusted under 35 U.S.C. 154(b) by 67 days.

(21) Appl. No.: 09/716,662

(22) Filed: Nov. 21, 2000

(51) Int. Cl.[7] ..... A24F 13/02; A24F 13/08; A24F 13/22

(52) U.S. Cl. ..... 131/175; 131/330; 131/178; 131/187; 131/190; 131/200; 131/201; 131/202; 131/206; 131/211; 131/215.1; 131/215.2

(58) Field of Search ..... 131/200, 201, 131/202, 205, 206, 211, 187, 212.1, 178, 212.2, 215.1, 215.2, 215.3, 341, 231, 344, 175; 55/385.8; D27/183, 186, 187, 189, 193

(56) References Cited

U.S. PATENT DOCUMENTS

| | | | | | |
|---|---|---|---|---|---|
| 3,362,415 | A | * | 1/1968 | Ellis | 131/175 |
| 3,827,444 | A | * | 8/1974 | Khan | 131/174 |
| 4,164,230 | A | * | 8/1979 | Pearlman | 131/330 |
| 4,200,114 | A | * | 4/1980 | Waite | 131/178 |
| 4,289,149 | A | * | 9/1981 | Kyriakou | 131/175 |
| 4,369,798 | A | * | 1/1983 | Jackson | 131/187 |
| 4,790,332 | A | * | 12/1988 | Wallace | 131/175 |
| 4,807,646 | A | * | 2/1989 | Sahar | 131/175 |
| 4,922,931 | A | * | 5/1990 | Nare et al. | 131/211 |
| D315,617 | S | * | 3/1991 | Boutte | D27/194 |
| 5,160,518 | A | * | 11/1992 | Vega, Jr. | 131/200 |
| 5,388,595 | A | * | 2/1995 | Shafer | 131/175 |
| 5,396,907 | A | * | 3/1995 | Rojas Henao et al. | 131/175 |
| 5,469,870 | A | * | 11/1995 | Meador | 131/187 |
| 5,529,078 | A | * | 6/1996 | Rehder et al. | 131/175 |
| 5,598,853 | A | * | 2/1997 | Hyre | 131/175 |
| D399,600 | S | * | 10/1998 | Bowen et al. | D27/194 |
| 6,012,459 | A | * | 1/2000 | Keefe | 131/185 |
| 6,345,625 | B1 | * | 2/2002 | Chew | 131/187 |

FOREIGN PATENT DOCUMENTS

| | | | |
|---|---|---|---|
| JP | 5-207871 | * | 8/1993 |
| JP | 6-133755 | * | 5/1994 |
| JP | 8-214859 | * | 8/1996 |
| JP | 10-4945 | * | 1/1998 |
| JP | 11-178560 | * | 7/1999 |

* cited by examiner

*Primary Examiner*—Jose Fortuna
*Assistant Examiner*—Carlos Lopez
(74) *Attorney, Agent, or Firm*—Harry M. Weiss; Jeffrey Weiss; Weiss & Moy, P. C.

(57) ABSTRACT

A tobacco smoke containment apparatus and method therefor having the characteristics of limiting the exhaust of harmful smoke particles as well as reducing the overall risk of accidental fire by containing a smoking tobacco product inside a closed receptacle.

39 Claims, 2 Drawing Sheets

TOBACCO SMOKE CONTAINMENT APPARATUS AND METHOD THEREFOR

FIELD OF THE INVENTION

This invention relates generally to tobacco products and, more specifically, to a tobacco smoking containment apparatus and method therefor having the characteristic of reducing harmful particle exhaust and decreasing the incidence of accidental fire.

BACKGROUND OF THE INVENTION

There are many life-threatening dangers associated with smoking. The most notable is the threat of cancer. Most medical evidence points to a higher incidence of cancer among those who smoke as compared to those who do not smoke. Alarmingly, those who do not smoke but spend large amounts of time with smokers, have a higher incidence of cancer than other non-smokers. Many scientists attribute this result to "second hand smoke," which is the name given for the smoke inhaled by non-smokers who are in the vicinity of smokers. The health risks caused by tobacco smoke are therefore felt not only by those who choose to smoke, but quite often by those who do not. As a result or this situation, many jurisdictions throughout the United States and the rest of the world have passed laws which prohibit smokers from smoking in public areas. This situation has created, social tension between those who smoke and those who do not smoke with each group often feeling as though the other group is infringing on their rights. The smokers often feel that anti-smoking laws prevent them from excersising their free will, whereas the non-smokers often feel that by smoking, the smokers infringe on the non-smokers' right to breathe clean air.

Accidental fires are another adverse effect of smoking. A flaming cigarette, cigar, pipe, or the like if left unattended can lead to an accidental fire. Many smoking related fires occur when a smoker falls asleep with a lit tobacco product in his or her hand. The tobacco product then comes to rest on a couch, a bed, or other flammable surface and ignites a fire. As with second-hand smoke, accidental fire is a problem that clearly has negative consequences to both smokers and non-smokers alike.

A need therefore existed for a tobacco smoke containment apparatus capable of limiting the exhaust of harmful smoke particles as well as reducing the overall risk of accidental fire

SUMMARY OF THE INVENTION

An object of the present invention is to provide a tobacco smoke containment apparatus capable of reducing the overall risk of accidental fire.

It is a further object of the present invention to provide a tobacco smoke containment apparatus coupled to a filter device to prevent the exhaust of harmful smoke particles while at the same time reducing the overall risk of accidental fire.

It is a still further object of the present invention to provide a tobacco smoke containment apparatus comprising a receptacle coupled to a filtering chamber to prevent the exhaust of harmful smoke particles while at the same time reducing the overall risk of accidental fires.

It is a still further object of the present invention to provide a compact tobacco smoke containment apparatus comprising a receptacle and a filtering chamber dimensioned to receive the receptacle to prevent the exhaust of harmful smoke particles while at the same time reducing the overall risk of accidental fire.

BRIEF DESCRIPTION OF THE PREFERRED EMBODIMENTS

In accordance with one embodiment of the present invention, a tobacco smoke containment apparatus is disclosed, comprising, in combination, a receptacle having an open end and a closed end, the closed end defines an aperture therethrough, a cap dimensioned to be removably coupled to the open end of the receptacle, the cap defines a first opening and a second opening, an inhale tube adapted to permit a passage of smoke from a tobacco product to a smoker and having a first end and a second end and coupled to the cap through the first opening of the cap, the second end of the inhale tube extends inside the receptacle when the cap is coupled to the receptacle and the second end or the inhale tube is adapted to be removably coupled to a tobacco product, an exhale tube adapted to permit a passage of smoke exhaled by a smoker into the receptacle and having a first end and a second end and coupled to the cap through the second opening of the cap, the second end of the exhale tube extends inside the receptacle when the cap is coupled to the receptacle, an exhaust tube adapted to permit an exhaust of smoke from the receptacle and having a first end and a second end, the first end of the exhaust tube is coupled to the closed end of the receptacle through the aperture of the closed end and the second end of the exhaust tube extends away from the closed end of the receptacle, and a filtering chamber having a first end and a second end, the first end of the filtering chamber is coupled to the second end of the exhaust tube and the second end of the filtering chamber is coupled to an exit tube, the filtering chamber is adapted to limit a passage of harmful particles generated by tobacco smoke from exiting the filtering chamber through the exit tube.

In accordance with another embodiment of the present invention, a tobacco smoke containment apparatus is disclosed, comprising, in combination, a receptacle having an open end a closed end, the closed end defines an aperture therethrough, a cap dimensioned to be removably coupled to the open end of the receptacle, the cap defines a first opening and a second opening, an inhale tube adapted to permit a passage of smoke from a tobacco product to a smoker and having a first end and a second end and coupled to the cap through the first opening of the cap, the second end of the inhale tube extends inside the receptacle when the cap is coupled to the receptacle and the second end of the inhale tube is adapted to be removably coupled to a tobacco product, an exhale tube adapted to permit a passage of smoke exhaled by a smoker into the receptacle and having a first end and a second end and coupled to the cap through the second opening of the cap, the second end of the exhale tube extends inside the receptacle when the cap is coupled to the receptacle and an exhaust tube adapted to permit an exhaust of smoke from the receptacle and having a first end and a second end, the first end of the exhaust tube is coupled to the closed end of the receptacle through the aperture of the closed end and the second end of the exhaust tube extends away from the closed end of the receptacle.

In accordance with still another embodiment of the present invention, a tobacco smoke containment apparatus is disclosed, comprising, in combination, a receptacle having an open end and a closed end, the closed end defines an aperture therethrough, a cap dimensioned to be removably coupled to the open end of the receptacle, the cap defines a first opening and a second opening, an inhale tube adapted to permit a passage of smoke from a tobacco product to a smoker and having a first end and a second end and coupled to the cap through the first opening of the cap, the second end of the inhale tube extends inside the receptacle when the cap is coupled to the receptacle and the second end of the inhale tube is adapted to be removably coupled to a tobacco product, an exhale tube adapted to permit a passage of smoke exhaled by a smoker into the receptacle and having a first end and a second end and coupled to the cap through the second opening of the cap, the second end of the exhale tube extends inside the receptacle when the cap is coupled to the receptacle, an exhaust tube adapted to permit an exhaust or smoke from the receptacle and having a first end and a second end, the first end of the exhaust tube is coupled to the closed end of the receptacle through the aperture of the closed end and the second end of the exhaust tube extends away from the closed end of the receptacle, and a filter screen coupled to the closed end of the receptacle and adapted to limit a passage of harmful particles generated by smoke from being exhausted through the exhaust tube.

In accordance with still another embodiment of the present invention, a tobacco smoke containment apparatus is disclosed, comprising, in combination, a receptacle having an open end and a closed end, the closed end defines an aperture therethrough, a cap dimensioned to be removably coupled to the open end of the receptacle, the cap defines a first opening and a second opening, an inhale tube adapted to permit a passage of smoke from a tobacco product to a smoker and having a first end and a second end and coupled to the cap through the first opening of the cap, the second end of the inhale tube extends inside the receptacle when the cap is coupled to the receptacle and the second end of the inhale tube is adapted to be coupled to a tobacco product, an exhale tube adapted to permit a passage of smoke exhaled by a smoker into the receptacle and having a first end and a second end and coupled to the cap through the second opening of the cap, the second end of one exhale tube extends inside the receptacle when the cap is coupled to the receptacle, and a filtering chamber having at least one exhaust opening and dimensioned to receive the receptacle and adapted to permit a passage of smoke from the aperture of the closed end of the receptacle to the filtering chamber and adapted to limit a passage of harmful particles generated by smoke from exiting the filtering chamber through the at least one exhaust opening of the filtering chamber.

In accordance with still another embodiment of the present invention, a method for containing tobacco smoke is disclosed, comprising, in combination, the steps of providing a receptacle having an open end and a closed end, the closed end defines an aperture therethrough, providing a cap dimensioned to be removably coupled to the open end of the receptacle, the cap defines a first opening and a second opening, coupling the cap to the open end of the receptacle, providing an inhale tube having a first end and a second end, the second end of the inhale tube extends inside the receptacle when the cap is coupled to the receptacle, coupling the inhale tube to the cap through the first opening of the cap, coupling the second end of the inhale tube to a tobacco product, inhaling smoke through the first end of the inhale tube from the tobacco product, providing an exhale tube having a first end and a second end, the second end of the exhale tube extends inside the receptacle when the cap if coupled to the receptacle, coupling the exhale tube to the cap through the second opening of the cap, exhaling smoke through the first end of the exhale tube from a mouth of a smoker, providing an exhaust tube adapted to permit an exhaust of smoke from the receptacle and having a first end and a second end, coupling the first end of the exhaust tube to the closed end of the receptacle through the aperture of the closed end, the second end of the exhaust tube extends away from the closed end of the receptacle, providing a filtering chamber having a first end and a second end, coupling the first end of the filtering chamber to the second end of the exhaust tube, and coupling the second end of the filtering chamber to an exit tube, the filtering chamber is adapted to limit a passage of harmful particles generated by tobacco smoke from exiting the filtering chamber through the exit tube.

In accordance with still another embodiment of the present invention a method for decreasing an incidence of fire from a tobacco product is disclosed, comprising, in combination, the steps of, providing a receptacle having an open end and a closed end, said closed end defines an aperture therethrough, providing a cap dimensioned to be removably coupled to the open end of the receptacle, said cap defines a first opening and a second opening, coupling said cap to said open end of said receptacle, providing an inhale tube having a first end and a second end, said second end of said inhale tube extends inside said receptacle when said cap is coupled to said receptacle, coupling said inhale tube to said cap through said first opening of said caps coupling said second end or said inhale tube to a tobacco product, inhaling smoke through said first end of said inhale tube from said tobacco product, providing an exhale tube having a first end and a second end, said second end of said exhale tube extends inside said receptacle when said cap is coupled to said receptacle, coupling said exhale tube to said cap through said second opening of said cap, exhaling smoke through said first end of said exhale tube from a mouth of a smoker, providing an exhaust tube adapted to permit an exhaust of smoke from said receptacle and having a first end and a second end, and coupling said first end of said exhaust tube to said closed end of said receptacle through said aperture of said closed end, said second end of said exhaust tube extends away from said closed end of said receptacle.

In accordance with still another embodiment of the present invention, a method for containing tobacco smoke is disclosed, comprising, in combination, the steps of providing a receptacle having an open end and a closed end, said closed end defines an aperture therethrough, providing a cap dimensioned to be removably coupled to the open end of the receptacle, said cap defines a first opening and a second opening, coupling said cap to said open end of said receptacle, providing an inhale tube having a first end and a second end, said second end of said inhale tube extends inside said receptacle when said cap is coupled to said receptacle, coupling said inhale tube to said cap through said first opening of said cap, coupling said second end of said inhale tube to a tobacco product, inhaling smoke through said first end of said inhale tube from said tobacco product, providing an exhale tube having a first end and a second end, said second end of said exhale tube extends inside said receptacle when said cap is coupled to said receptacle, coupling said exhale tube to said cap through said second opening of said cap, exhaling smoke through said first end of said exhale tube from a mouth of a smoker, providing an exhaust tube adapted to permit an exhaust of smoke from said receptacle and having a first and and a second end, coupling said first end of said exhaust tube to said closed end of said receptacle through said aperture of said closed end said second end of said exhaust tube extends away from said closed end of said receptacle, providing a filter screen, and coupling said filter screen to said closed end of said receptacle, said filter screen is adapted to limit a passage of harmful particles generated by smoke from being exhausted through said exhaust tube.

In accordance with still another embodiment of the present invention, a method for containing tobacco smoke is disclosed, comprising, in combination, the steps of providing a receptacle having an open end and a closed end, said closed end defines an aperture therethrough, providing a cap dimensioned to be removably coupled to the open end of the receptacle, said cap defines a first opening and a second opening, coupling said cap to said open end of said receptacle, providing an inhale tube having a first end and a second end, said second end of said inhale tube extends inside said receptacle when said cap is coupled to said receptacle, coupling said inhale tube to said cap through said first opening of said cap, coupling said second end of said inhale tube to a tobacco product, inhaling smoke through said first end of said inhale tube from said tobacco product, providing an exhale tube having a first end and a second end, said second end of said exhale tube extends inside said receptacle when said cap is coupled to said receptacle, coupling said exhale tube to said cap through said second opening of said cap, exhaling smoke through said first end of said exhale tube from a mouth of a smoker, providing an exhaust tube adapted to permit an exhaust of smoke from said receptacle and having a first end and a second end, coupling said first end of said exhaust tube to said closed end of said receptacle through said aperture of said closed end, said second end of said exhaust tube extends away from said closed end of said receptacle, providing a filtering chamber having at least one exhaust opening and dimensioned to receive said receptacle, and coupling said receptacle to said filtering chamber, said filtering chamber is adapted to permit a passage of smoke from said aperture of said closed end of said receptacle to said filtering chamber and adapted to limit a passage of harmful particles generated by smoke from exiting said filtering chamber through said at least one exhaust opening of said filtering chamber.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
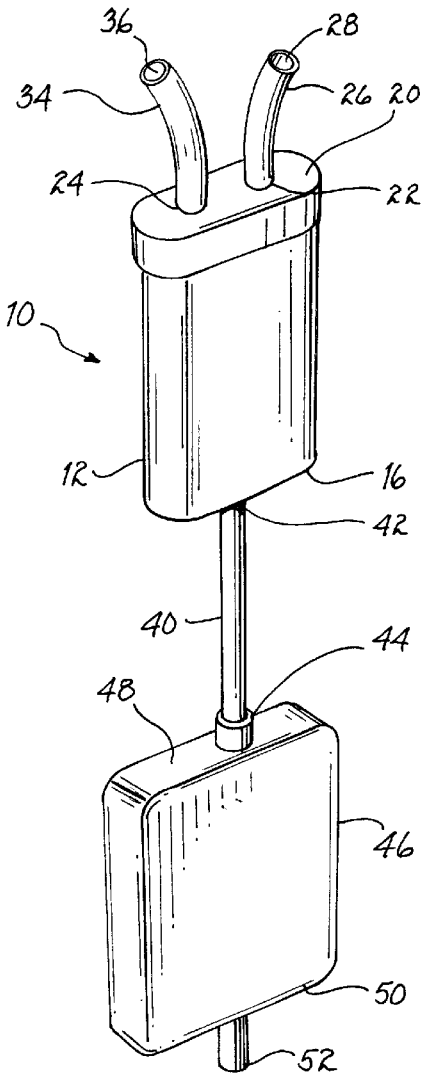
FIG. 1 is a perspective view of an embodiment of the tobacco smoke containment apparatus of the present invention.
Figure 2:
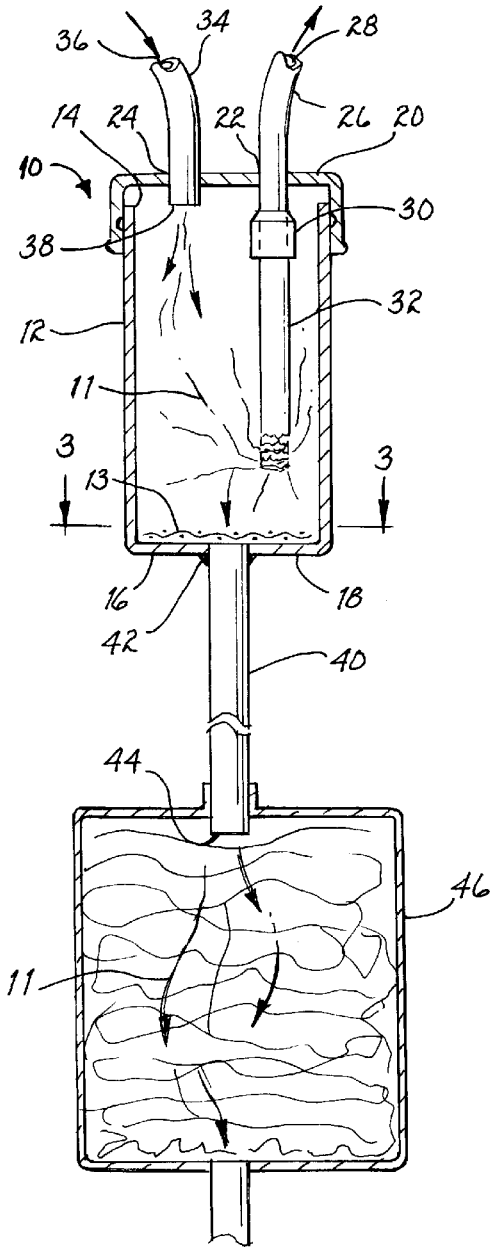
FIG. 2 is a side cross-sectional view of the tobacco smoke containment apparatus of FIG. 1.
Figure 3:
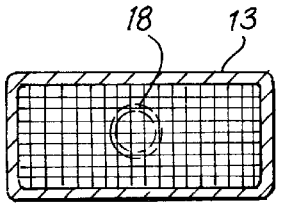
FIG. 3 is a top cross-sectional view of the tobacco smoke containment apparatus of FIG. 1, taken along line 3—3, showing the filter device.

Referring to FIGS. 1 and 2 reference number 10 refers generally to one embodiment of the tobacco smoke containment apparatus of the present invention. The tobacco smoke containment apparatus 10 comprises a receptacle 12 having an open end 14 (shown in FIG. 2) and a closed 16 The closed end 16 defines an aperture 18 (shown in FIG. 2) therethrough. In the preferred embodiment, the receptacle 12 comprises a filter screen 13 (shown in, FIGS. 2 and 3), which is adapted to limit the passage of harmful particles generated by tobacco smoke 11, although it should be clearly understood that substantial benefit could be derived from an alternative configuration of the tobacco smoke contentment apparatus 10 which lacks a filter screen 13. In the event that the tobacco smoke contentment apparatus 10 is configured without a filter screen 13, the receptacle 12 is still useful in its ability to decrease the incidence of accidental fire by containing a smoking tobacco product 32. Preferably, the tobacco smoke containment apparatus 10 is constructed of a flame-retardant material in order to prevent the smoking tobacco product 32 from coming into contact with a flammable surface and igniting a fire.

Still referring to FIGS. 1 and 2, the tobacco smoke containment apparatus 10 further comprises a cap 20 dimensioned to be removably coupled to the open end 14 of the receptacle 12. The cap 20 defines a first opening 22 and a second opening 24. The tobacco smoke containment apparatus 10 further comprises an inhale tube 26 having a first end 28 and a second end 30 (shown in FIG. 2). The inhale tube 26 is coupled to the cap 20 through the first opening 22. The second end 30 of the inhale tube 26 extends inside the receptacle 12 when the cap 20 is coupled to the receptacle 12. The inhale tube 26 is adapted to permit a passage of smoke 11 from a tobacco product 32 (shown in FIG. 2) to a smoker (not shown). The second end 30 of the inhale tube 26 is adapted to be removably coupled to a tobacco product 32. It should be understood that the tobacco product 32 could be in the form of a cigarette, a cigar, pipe tobacco or other smokeable substances. For example, the tobacco smoke containment apparatus 10 could therefore be configured in different sizes with one size designed with a wide inhale tube 26 to accommodate a cigar and another size designed with a narrow inhale tube 26 to accommodate a cigarette. Similarly, other configurations of the tobacco smoke containment apparatus 10 could be designed to accomodate different sized tobacco products 32 or other smokeable sources.

The tobacco smoke contentment apparatus 10 further comprises an exhale tube 34 having a first end 36 and a second end 35 (shown in FIG. 2). The exhale tube 34 is coupled to the cap 20 through the second opening 24 of the cap 20. The second end 38 of the exhale tube 34 extends inside the receptacle 12 when the cap 20 is coupled to the receptacle 12. The exhale tube 34 is adapted to permit a passage of smoke 11 exhaled by a smoker into the receptacle 12. In the preferred embodiment, the cap 20, the inhale tube 26 and the exhale tube 34 together comprise a one-piece assembly, although it should be clearly understood that substantial benefit could be derived from an alternative configuration of the tobacco smoke containment apparatus 10 in which the cap 20, the inhale tube 26 and the exhale tube 34 are separate components, so long as they can be securely coupled together.

Still referring to FIGS. 1 and 2, the tobacco smoke containment apparatus 10 further comprises an exhaust tube 40 having a first end 42 and a second end 44. The first end 42 of the exhaust tube 40 is coupled to the closed end 16 of the receptacle 12 through the aperture 19 of the closed end 16. When coupled, the exhaust tube 40 extends away from the closed end 16 of the receptacle 12. The exhaust tube 40 is adapted to permit an exhaust of smoke 11 from the receptacle 12.

The tobacco smoke containment apparatus 10 further comprises a filtering chamber 46 having a first end 48 and a second end 50. The first end 48 of the filtering chamber 46 is coupled to the second end 44 of the exhaust tube 40. The second end 50 of the filtering chamber 46 is coupled to an exit tube 52. The filtering chamber 46 is adapted to limit the passage of harmful particles generated by tobacco smoke 11 from exiting the filtering chamber 46 through the exit tube 52. In the preferred embodiment, the receptacle 12, the filtering chamber 46, the exhaust tube 40 and the exit tube 52 together comprise a one-piece assembly, although it should be clearly understood that substantial benefit could be derived from an alternative configuration of the tobacco smoke containment apparatus 10 in which the receptacle 12, the filtering chamber 46, the exhaust tube 40 and the exit tube 52 are separate components, so long as they can be securely coupled together.

Figure 4:
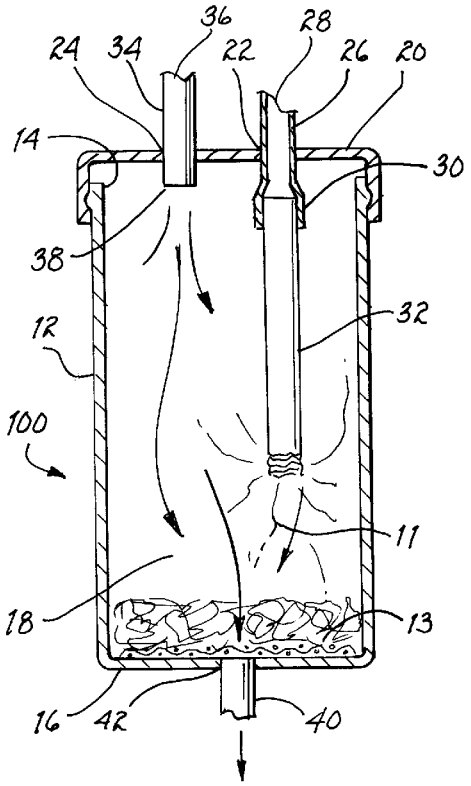
FIG. 4 is a side cross-sectional view or another embodiment of the tobacco smoke containment apparatus of the present invention.

Referring now to FIG. 4, an alternative embodiment of the tobacco smoke containment apparatus 10, hereinafter 100, is shown. The tobacco smoke containment apparatus 100 is essentially the same as before, although the tobacco smoke containment apparatus 100 lacks a filtering chamber 46 or an exit tube 52. The tobacco smoke containment apparatus 100 is substantially smaller and more compact in size than the tobacco smoke containment apparatus 10 Preferably, the receptacle 12 of the tobacco smoke containment apparatus 100 comprises a filter screen 13 (shown in FIG. 4), which is adapted to limit the passage of harmful particles generated by tobacco smoke 11, although it should be clearly understood that substantial benefit could be derived from an alternative embodiment of the tobacco smoke contentment apparatus 100 which lacks a filter screen 13. In the event that the tobacco smoke contentment apparatus 100 is configured without a filter screen 13, the receptacle 12 is still useful in its ability to decrease the incidence of accidental fire by containing a smoking tobacco product 32. Preferably, the tobacco smoke containment apparatus 100 is constructed of a flame-retardant material in order to prevent the smoking tobacco product 32 from coming into contact with a flammable surface and igniting a fire.

Figure 6:
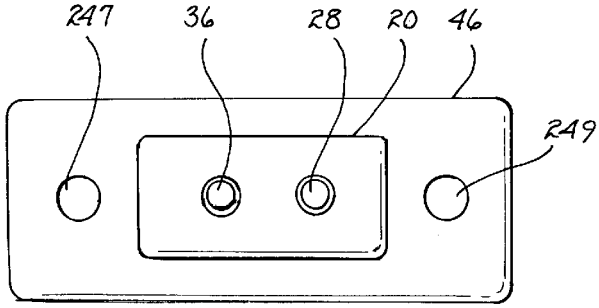
FIG. 6 is a top view of the tobacco smoke containment apparatus of FIG. 5.
Figure 5:
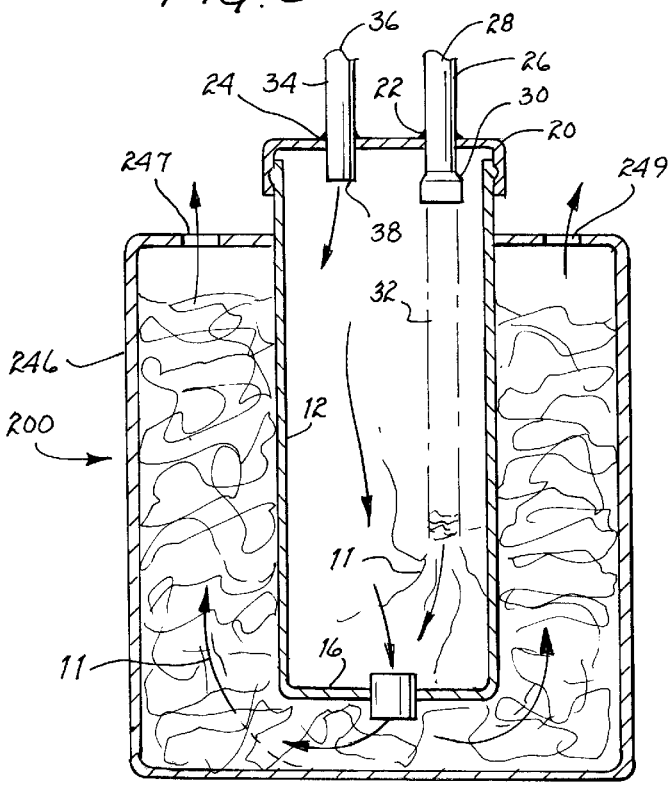
FIG. 5 is a side cross-sectional view of yet another embodiment of the tobacco smoke containment apparatus of the present invention.

Referring now to FIGS. 5 and 6, an alternative embodiment of the tobacco smoke containment apparatus 10, hereinafter 200, is shown. The tobacco smoke containment apparatus 200 is essentially the same as the tobacco smoke containment apparatus 10, although the filtering chamber 46, hereinafter 246 is dimensioned to receive the receptacle 12. The filtering chamber 246 preferably has two exhaust openings 247 and 249, although it should be clearly understood that substantial benefit could be derived from an alternative configuration of the filtering chamber 245 in which as few as one exhaust opening 247 is used. The exhaust openings 247 and 249 in the filtering chamber 246 of the tobacco smoke containment apparatus 200 serve the same purpose as the exit tube 42 of the receptacle 46 in the tobacco smoke containment apparatus 10. The tobacco smoke containment apparatus 200 is smaller in size and more compact than the tobacco smoke containment apparatus 10.

STATEMENT OF OPERATION

In order to operate the tobacco smoke containment apparatus 10, a smoker first attaches an end of a tobacco product 32 to the second end 30 of the inhale tube 26. The smoker then lights the tobacco product 32 and places his or her mouth on the first end 28 of the inhale tube 26 and begins to inhale in order to begin the flow of smoke 11 from the tobacco product 32 to the mouth of the smoker. The cap 20 is then coupled to the open end 14 of the receptacle 12 with the smoking tobacco product 32 inside the receptacle 12. The smoker continues to inhale the smoke through the inhale tube 26. After each inhaler the smoker than places his or her mouth on the first end 36 of the exhale tube 34 and exhales the recently Inhaled smoke. The receptacle 12 collects both the smoke 11 from the smoking tobacco product 32 and the smoke 11 exhaled by the smoker.

In several embodiments, the smoke 11 is then filtered through a filter screen 13 which is coupled to the closed end 16 of the receptacle 12. With or without the filter screen 13, the smoke 11 in the tobacco smoke containment apparatus 10 then travels down the exhaust tube 40 and to the filtering chamber 46. The smoke 11 is then filtered by the filtering chamber 46 in order to limit the passage of harmful particles generated by the tobacco smoke 11 from exiting the filtering chamber 46 through the exit tube 52.

In the tobacco smoke containment apparatus 100 a filter screen 13 may or may not be coupled to the closed end 16 of the receptacle 12. If the tobacco smoke containment apparatus 100 comprises a filter screen 13 then the smoke 11 will be filtered. However, if the tobacco smoke containment apparatus 100 lacks a filter screen 13 then unfiltered smoke 11 will exit the receptacle 12 through the exhaust tube 40. In this embodiment, the purpose of the receptacle 12 is not to filter the smoke 11 but rather to decrease the incidence of accidental fire by keeping the smoking tobacco product 32 enclosed and away from flammable surfaces.

In the tobacco smoke containment apparatus 200, the smoke 11 travels through the aperture 18 of the closed end 16 of the receptacle 12 into the filtering chamber 246. Once in the filtering chamber 246 the smoke 11 is then filtered to limit the passage of harmful particles generated by the tobacco smoke 11 from exiting the filtering chamber 246 through the exhaust openings 247 and 249.

While the invention has been particularly shown and described with reference to preferred embodiments thereof, it will be understood by those skilled in the art that the foregoing and other changes in form and details may be made therein without, departing from the spirit and scope of the invention.

I claim:

1. A tobacco smoke containment apparatus comprising, in combination:

a receptacle having an open end and a closed end, said closed end defines an aperture therethrough;

a cap dimensioned to be removably coupled to said open end of said receptacle, said cap defines a first opening and a second opening;

an inhale tube adapted to permit a passage of smoke from a tobacco product to a smoker and having a first end and a second end and coupled to said cap through said first opening of said cap, said second end of said inhale tube extends inside said receptacle when said cap is coupled to said receptacle and said second end of said inhale tube is adapted to be removably coupled to a tobacco product;

an exhale tube adapted to permit a passage of smoke exhaled by a smoker into said receptacle and having a first end and a second end and coupled to said cap through said second opening of said cap, said second end of said exhale tube extends inside said receptacle when said cap is coupled to said receptacle;

an exhaust tube adapted to permit an exhaust of smoke from said receptacle and having a first end and a second end, said first end of said exhaust tube is coupled to said closed end of said receptacle through said aperture of said closed end and said second end of said exhaust tube extends away from said closed end of said receptacle; and a filtering chamber having a first end and a second end, said first end of said filtering chamber is coupled to said second end of said exhaust tube and said second end of said filtering chamber is coupled to an exit tube, said filtering chamber is adapted to limit a passage of harmful particles generated by tobacco smoke from exiting said filtering chamber through said exit tube.

2. The apparatus of claim 1 further comprising a filter screen coupled to said closed end of said receptacle, said filter screen is adapted to limit a passage of harmful particles generated by tobacco smoke.

3. The apparatus of claim 1 wherein said inhale tube and said exhale tube and said cap comprise a one-piece assembly.

4. The apparatus of claim 1 wherein said receptacle and said exhaust tube and said filtering chamber and said exit tube comprise a one-piece assembly.

5. The apparatus of claim 1 wherein said tobacco smoke containment apparatus is constructed of a flame-retardant material.

6. The apparatus of claim 1 wherein said tobacco product is a cigarette.

7. The apparatus of claim 1 wherein said tobacco product is a cigar.

8. The apparatus of claim 1 wherein said tobacco product is a tobacco pipe.

9. The apparatus of claim 1 wherein said tobacco product is a smokeable substance.

10. A tobacco smoke containment apparatus comprising, in combination:

a receptacle having an open end and a closed end, said closed end defines an aperture therethrough;

a cap dimensioned to be removably coupled to said open end of said receptacle, said cap defines a first opening and a second opening;

an inhale tube adapted to permit a passage of smoke from a tobacco product to a smoker and having a first end and a second end and coupled to said cap through said first opening of said cap, said second end of said inhale tube extends inside said receptacle when said cap is coupled to said receptacle and said second end of said inhale tube is adapted to be removably coupled to a tobacco product;

an exhale tube adapted to permit a passage of smoke exhaled by a smoker into said receptacle and having a first end and a second end and coupled to said cap through said second opening of said cap, said second end of said exhale tube extends inside said receptacle when said cap is coupled to said receptacle; and an exhaust tube adapted to permit an exhaust of smoke from said receptacle and having a first end and a second end, said first end of said exhaust tube is coupled to said closed end of said receptacle through said aperture of said closed end and said second end of said exhaust tube extends away from said closed end of said receptacle.

11. The apparatus of claim 10 further comprising a filter screen coupled to said closed end or said receptacle, said filter screen is adapted to limit a passage of harmful particles generated by tobacco smoke.

12. The apparatus of claim 10 wherein said inhale tube and said exhale tube and said cap comprise a one-piece assembly.

13. The apparatus of claim 10 wherein said receptacle and said exhaust tube comprise a one-piece assembly.

14. The apparatus of claim 10 wherein said tobacco smoke containment apparatus is constructed of a flame-retardant material.

15. The apparatus of claim 10 wherein said tobacco product is a cigarette.

16. The apparatus of claim 10 wherein said tobacco product is a cigar.

17. The apparatus of claim 10 wherein said tobacco product is a tobacco pipe.

18. The apparatus of claim 10 wherein said tobacco product is a smokeable substance.

19. A tobacco smoke containment apparatus comprising, in combination:

a receptacle having an open end and a closed end, said closed end defines an aperture therethrough;

a cap dimensioned to be removably coupled to said open end of said receptacle, said cap defines a first opening and a second opening;

an inhale tube adapted to permit a passage of smoke from a tobacco product to a smoker and having a first end and a second end and coupled to said cap through said first opening of said cap, said second end of said inhale tube extends inside said receptacle when said cap is coupled to said receptacle and said second end of said inhale tube is adapted to be removably coupled to a tobacco product;

an exhale tube adapted to permit a passage of smoke exhaled by a smoker into said receptacle and having a first end and a second end and coupled to said cap through said second opening of said cap, said second end or said exhale tube extends inside said receptacle when said cap is coupled to said receptacle;

an exhaust tube adapted to permit an exhaust of smoke from said receptacle and having a first end and a second end, said first end of said exhaust tube is coupled to said closed end of said receptacle through said aperture of said closed end and said second end of said exhaust tube extends away from said closed end of said receptacle; and a filter screen coupled to said closed end of said receptacle and adapted to limit a passage of harmful particles generated by smoke from being exhausted through said exhaust tube.

20. The apparatus of claim 19 wherein said inhale tube and said exhale tube and said cap comprise a one-piece assembly.

21. The apparatus of claim 19 wherein said receptacle and said exhaust tube and said filter device comprise a one-piece assembly.

22. The apparatus of claim 19 wherein said tobacco smoke containment apparatus is constructed of a flame-retardant material.

23. The apparatus of claim 19 wherein said tobacco product is a cigarette.

24. The apparatus of claim 19 wherein said tobacco product is a cigar.

25. The apparatus of claim 19 wherein said tobacco product is a tobacco pipe.

26. The apparatus of claim 19 wherein said tobacco product is a smokable substance.

27. A tobacco smoke containment apparatus comprising, in combination:

a receptacle having an open end and a closed end, said closed end defines an aperture therethrough;

a cap dimensioned to be removably coupled to said open end of said receptacle, said cap defines a first opening and a second opening;

an inhale tube adapted to permit a passage of smoke from a tobacco product to a smoker and having a first end and a second end and coupled to said cap through said first opening of said cap, said second end of said inhale tube extends inside said receptacle when said cap is coupled to said receptacle and said second end of said inhale tube is adapted to be coupled to a tobacco product;

an exhale tube adapted to permit a passage of smoke exhaled by a smoker into said receptacle and having a first end and a second end and coupled to said cap through said second opening of said cap, said second end of said exhale tube extends inside said receptacle when said cap is coupled to said receptacle; and a filtering chamber having at least one exhaust opening and dimensioned to receive said receptacle and adapted to permit a passage of smoke from said aperture of said closed end of said receptacle to said filtering chamber and adapted to limit a passage of harmful particles generated by smoke from exiting said filtering chamber through said at least one exhaust opening of said filtering chamber.

28. The apparatus or claim 27 wherein said filtering chamber has two exhaust openings.

29. The apparatus or claim 27 wherein said inhale tube and said exhale tube and said cap comprise a one-piece assembly.

30. The apparatus of claim 27 wherein said receptacle and said exhaust tube and said filtering chamber comprise a one-piece assembly.

31. The apparatus of claim 27 wherein said tobacco smoke containment apparatus is constructed of a flame-retardant material.

32. The apparatus of claim 27 wherein said tobacco product is a cigarette.

33. The apparatus of claim 27 wherein said tobacco product is a cigar.

34. The apparatus of claim 27 wherein said tobacco product is a tobacco pipe.

35. The apparatus of claim 27 wherein said tobacco product is a smokeable substance.

36. A method for containing tobacco smoke comprising, in combination, the steps of:

providing a receptacle having an open end and a closed end, said closed end defines an aperture therethrough;

providing a cap dimensioned to be removably coupled to said open end of said receptacle, said cap defines a first opening and a second opening;

coupling said cap to said open end of said receptacle, providing an inhale tube having a first and and a second end, said second end of said inhale tube extends inside said receptacle when said cap is coupled to said receptacle;

coupling said inhale tube to said cap through said first opening of said cap;

coupling said second end of said inhale tube to a tobacco product;

inhaling smoke through said first end of said inhale tube from said tobacco product;

providing an exhale tube having a first end and a second end said second end of said exhale tube extends inside said receptacle when said cap is coupled to said receptacle;

coupling said exhale tube to said cap through said second opening of said cap;

exhaling smoke through said first end of said exhale tube from a mouth of a smoker;

providing an exhaust tube adapted to permit an exhaust of smoke from said receptacle and having a first end and a second end;

coupling said first end of said exhaust tube to said closed end of said receptacle through said aperture of said closed end, said second end of said exhaust tube extends away from said closed end of said receptacle;

providing a filtering chamber having a first end and a second end;

coupling said first end of said filtering chamber to said second end of said exhaust tube; and coupling said second end of said filtering chamber to an exit tube, said filtering chamber is adapted to limit a passage of harmful particles generated by tobacco smoke from exiting said filtering chamber through said exit tube.

37. A method for decreasing an incidence of fire from a tobacco product comprising, in combination, the steps of:

providing a receptacle hating an open end and a closed end, said closed end defines an aperture therethrough;

providing a cap dimensioned to be removably coupled to said open end of said receptacle, said cap defines a first opening and a second opening;

coupling said cap to said open end of said receptacle;

providing an inhale tube having a first end and a second end, said second end of said inhale tube extends inside said receptacle when said cap is coupled to said receptacle;

coupling said inhale tube to said cap through said first opening of said cap;

coupling said second end of said inhale tube to a tobacco product;

inhaling smoke through said first end of said inhale tube from said tobacco product;

providing an exhale tube having a first end and a second end, said second end of said exhale tube extends inside said receptacle when said cap is coupled to said receptacle;

coupling said exhale tube to said cap through said second opening of said cap;

exhaling smoke through said first end of said exhale tube from a mouth of a smoker;

providing an exhaust tube adapted to permit an exhaust of smoke from said receptacle and having a first end and a second end; and coupling said first end of said exhaust tube to said closed end of said receptacle through said aperture of said closed end, said second end of said exhaust tube extends away from said closed end of said receptacle.

38. A method for containing tobacco smoke comprising, in combination, the steps of:

providing a receptacle having an open end and a closed end, said closed end defines an aperture therethrough;

providing a cap dimensioned to be removably coupled to said open end of said receptacle, said cap defines a first opening and a second opening;

coupling said cap to said open end of said receptacle, providing an inhale tube having a first end and a second end, said second end of said inhale tube extends inside said receptacle when said cap is coupled to said receptacle;

coupling said inhale tube to said cap through said first opening of said cap;

coupling said second end of said inhale tube to a tobacco product;

inhaling smoke through said first end of said inhale tube from said tobacco product;

providing an exhale tube having a first end and a second end, said second end of said exhale tube extends inside said receptacle when said cap is coupled to said receptacle;

coupling said exhale tube to said cap through said second opening of said cap;

exhaling smoke through said first end of said exhale tube from a mouth of a smoker;

providing an exhaust tube adapted to permit an exhaust of smoke from said receptacle and having a first end and a second end, coupling said first end of said exhaust tube to said closed end of said receptacle through said aperture of said closed end, said second end of said exhaust tube extends away from said closed end of said receptacle;

providing a filter screen; and coupling said filter screen to said closed end of said receptacle, said filter screen is adapted to limit a passage of harmful particles generated by smoke from being exhausted through said exhaust tube.

39. A method for containing tobacco smoke comprising, in combination, the steps of:

providing a receptacle having an open end and a closed end, said closed end defines an aperture therethrough;

providing a cap dimensioned to be removably coupled to said open end of said receptacle, said cap defines a first opening and a second opening;

coupling said cap to said open end of said receptacle, providing an inhale tube having a first end and a second end, said second end of said inhale tube extends inside said receptacle when said cap is coupled to said receptacle;

coupling said inhale tube to said cap through said first opening of said cap;

coupling said second end of said inhale tube to a tobacco product;

inhaling smoke through said first end of said inhale tube from said tobacco product;

providing an exhale tube having a first end and a second end, said second end of said exhale tube extends inside said receptacle when said cap is coupled to said receptacle;

coupling said exhale tube to said cap through said second opening of said cap;

exhaling smoke through said first end of said exhale tube from a mouth of a smoker;

providing an exhaust tube adapted to permit an exhaust of smoke from said receptacle and having a first end and a second end;

coupling said first end of said exhaust tube to said closed end of said receptacle through said aperture of said closed end, said second end of said exhaust tube extends away from said closed end of said receptacle;

providing a filtering chamber having at least one exhaust opening and dimensioned to receive said receptacle; and coupling said receptacle to said filtering chamber, said filtering chamber is adapted to permit a passage of smoke from said aperture of said closed end of said receptacle to said filtering chamber and adapted to limit a passage of harmful particles generated by smoke from exiting said filtering chamber through said at least one exhaust opening of said filtering chamber.

* * * * *